US005927153A

United States Patent [19]

Bhangoo et al.

[11] Patent Number: 5,927,153

[45] Date of Patent: Jul. 27, 1999

[54] PIVOTAL FOOT PEDAL ASSEMBLY

[75] Inventors: Jharmal S. Bhangoo, Durham; Eric W. Fogleman, Four Oaks, both of N.C.

[73] Assignee: Caterpillar Inc., Peoria, Ill.

[21] Appl. No.: 08/744,790

[22] Filed: Nov. 6, 1996

[51] Int. Cl.[6] ..... G05G 1/14

[52] U.S. Cl. ..... 74/512; 74/560

[58] Field of Search ..... 74/512, 560, 474; 280/231, 594.4, 594.7

[56] References Cited

U.S. PATENT DOCUMENTS

| | | | |
|---|---|---|---|
| 3,575,063 | 4/1971 | Harrom | 74/512 |
| 3,828,625 | 8/1974 | Bruhn | 74/512 |
| 3,943,795 | 3/1976 | Kenney | 74/562.5 |
| 4,225,130 | 9/1980 | Zimmerman | 74/594.4 |
| 4,401,315 | 8/1983 | Pavincic | 74/594.1 |
| 4,779,481 | 10/1988 | Natzke et al. | 74/512 |
| 4,883,137 | 11/1989 | Wanie et al. | 74/512 X |
| 5,056,742 | 10/1991 | Sakurai | 74/512 X |

*Primary Examiner*—Vinh T. Luong
*Attorney, Agent, or Firm*—Diana L. Charlton

[57] ABSTRACT

A pedal assembly is pivotably connected to a rod through a shaft of a linkage assembly. The rod has an intermediate portion and the pedal assembly is pivotable between a first and a second position so that an external pressure source may be applied thereto for operation of a boom arm of a construction machine. The pedal assembly has a foot plate with an upper and lower portion and is connected at a distal end portion of the rod through a pair of mounting ears. The lower portion of the pedal assembly contacts the distal end portion of the rod at the first position. The upper portion of the pedal assembly contacts the intermediate portion of the rod at the second position. The angular position of the pedal assembly may be selected by an operator through a block connected at the end of the rod opposite the distal end portion. An adjustment plate may be positioned precisely on the intermediate portion of the rod so that the selected angular position of the block may be maintained throughout operation.

8 Claims, 4 Drawing Sheets

PIVOTAL FOOT PEDAL ASSEMBLY

TECHNICAL FIELD

This invention relates generally to foot pedals for a construction machine and more particularly to the pivotal connection of the foot pedal to increase operator comfort and visibility.

BACKGROUND ART

Foot pedals assemblies for controlling a boom arm of a construction machine normally include large foot pedals capable of pivotally moving between a first position and a second position. When an operator places a foot on a first foot pedal and applies a force to a first actuating rod underneath, the boom is moved in a first direction. Conversely, when the operator places another foot on an opposite foot pedal and applies a force to a second actuating rod underneath, the boom is moved in a second direction opposite the first direction. The size of the foot pedals and the fixed orientation of an attached foot plate decreases the operator's comfort. Additionally, the operator has limited floor space to position his feet when not using the foot pedal. The limited space forces the operator to be in a position farther from the rear of the machine which decreases visibility into a work area. The decrease in visibility forces the operator to lean forward or get up to obtain good visibility during operation.

The present invention is directed to overcoming the problems as set forth above.

DISCLOSURE OF THE INVENTION

In one aspect of the present invention, a foot pedal assembly comprises a linkage assembly operatively associated with and connected to an actuating device. The linkage assembly has a shaft extending therethrough with a first end and a second end. A first rod assembly is connected to the first end of the shaft and has a first rod extending a predetermined distance from the shaft. The first rod has a distal end portion. A second rod assembly is connected to the second end of the shaft and has a second rod extending a predetermined distance from the shaft. The second rod having a distal end portion. A first pedal assembly is pivotally connected between a first and a second position at a predetermined pivot location near the distal end portion of the first rod. A second pedal assembly is pivotally connected between a first and a second position at a predetermined pivot location near the distal end portion of the second rod. The first and second pedal assemblies are operatively associated to control the actuating device.

In another aspect of the present invention, a construction machine has a frame, a boom arm connected to the frame and a cab portion connected to the frame at distance from the boom arm. The cab portion has a lower wall. The construction machine comprises a linkage assembly connected to the lower wall within the cab portion and being operatively associated with an actuating device. The linkage assembly has a pair of operatively associated shafts extending therethrough with a first end and a second end. A first rod assembly is connected to the first end of one of the pair of shafts and has a first rod extending a predetermined distance from the one of the pair of shafts. The first rod has a distal end portion. A second rod assembly is connected to the first end of the other of the pair of shafts and has a second rod extending a predetermined distance from the other of the pair of shafts. The second rod has a distal end portion. A first foot pedal assembly is pivotally connected for movement between a first position and a second position from an external source at a predetermined pivot location near the distal end portion of the first rod. A second foot pedal assembly is pivotally connected for movement between a first position and a second position from an external source at a predetermined pivot location near the distal end portion of the second rod.

In yet another aspect of the present invention, a construction machine has a frame. The construction machine comprises a linkage assembly connected to the frame and being operatively associated with an actuating device. The linkage assembly has a pair of operatively associated shafts extending therethrough with a first end and a second end. A first rod assembly is connected to the first end of one of the pair of shafts and has a first rod extending a predetermined distance from the one of the pair of shafts. The first rod has a distal end portion. A second rod assembly is connected to the first end of the other of the pair of shafts and has a second rod extending a predetermined distance from the other of the pair of shafts. The second rod has a distal end portion. A first foot pedal assembly is pivotally connected at a predetermined pivot location near the distal end portion of the first rod. A second foot pedal assembly is pivotally connected at a predetermined pivot location near the distal end portion of the second rod. The first and second foot pedal assemblies are operatively associated to control the actuating device.

The present invention includes a pair of foot pedal assemblies pivotably connected between a first and a second position at a specific location on a rod to increase operator comfort.

BEST MODE FOR CARRYING OUT THE INVENTION

Figure 1:
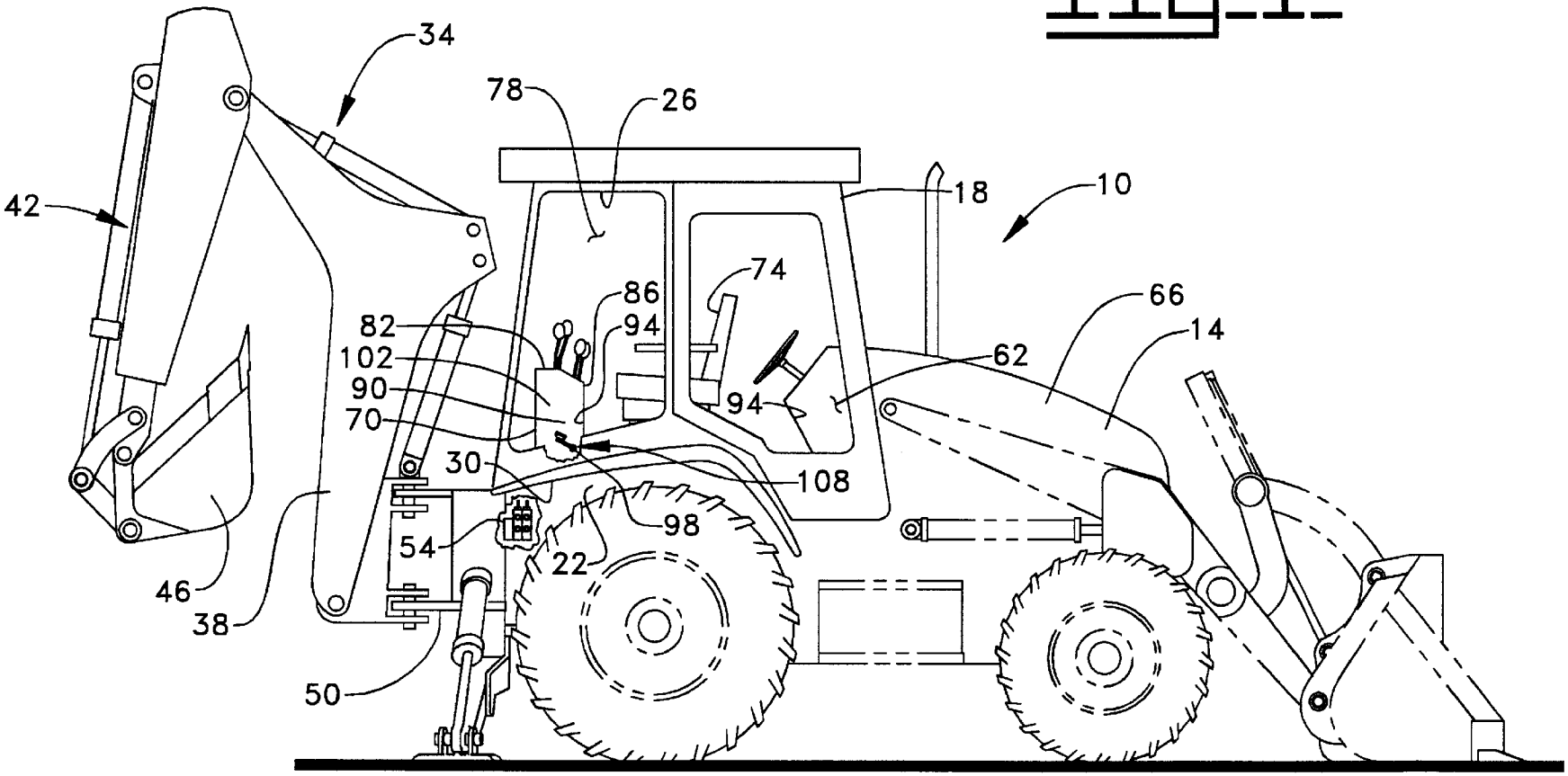
FIG. 1 is a diagrammatic front view of a backhoe loader showing a view of the present invention.

A construction machine 10, such as a backhoe loader, is shown in FIG. 1. It should be understood that although a backhoe loader will be described for use with the present invention, any suitable construction machine with a similar application need may be used. The backhoe loader 10 has a frame 14 and a cab portion 18 connected to the frame 14 in a well known manner. The cab portion 18 is located substantially at a central portion 22 of the frame 14 and has an upper and lower wall 26,30. A bucket assembly 34 including a boom arm 38, a stick assembly 42 and a bucket 46 is moveably connected to a rearward portion 50 of the frame 14. The bucket assembly 34 is connected to an actuating device 54, such as a plurality of valves, in a well known manner to coordinate movement of the boom arm 38, the stick assembly 42 and the bucket 46.

A front control console 62 is located within the cab portion 18 at a forward portion 66 of the frame 14. A rear control console 70 is located within the cab portion 18 at the rearward portion 50 of the frame 14 adjacent the bucket assembly 34. The front and the rear control consoles 62,70 are connected to the lower wall 30 of the cab portion 18 in a well known manner. An operator's seat 74 is located at a working station 78 within the cab portion 18 and is connected for rotation between the front and the rear control consoles 62,70. The rear control console 70 has a housing 82 with upper and lower portions 86,90 and an outer surface 94. The lower portion 90 of the housing 82 has a bore 98 which extends through a first side portion 102 and terminates at a second side portion (not shown).

Figure 2:
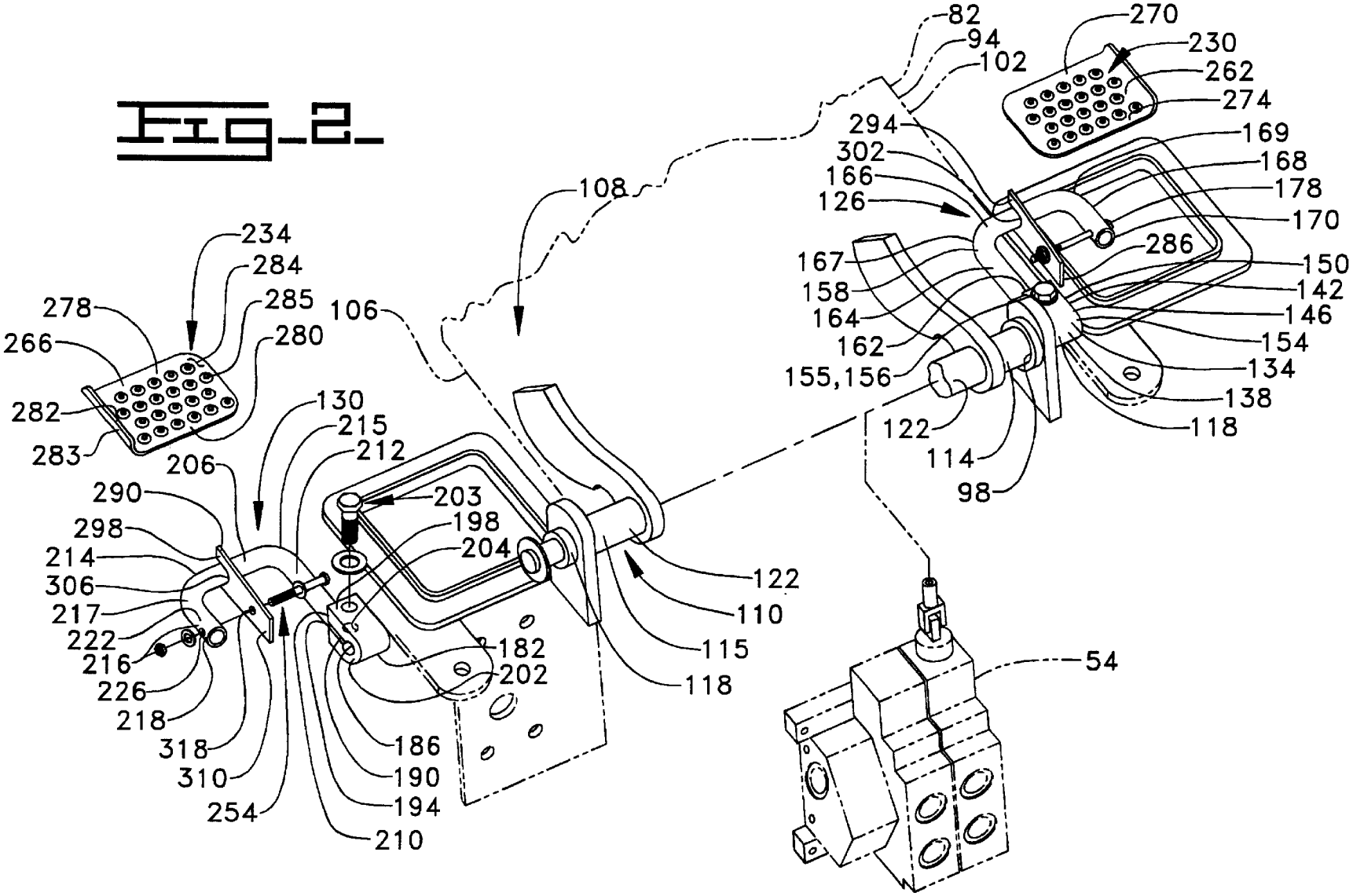
FIG. 2 is a diagrammatic exploded view of present invention.
Figure 4:
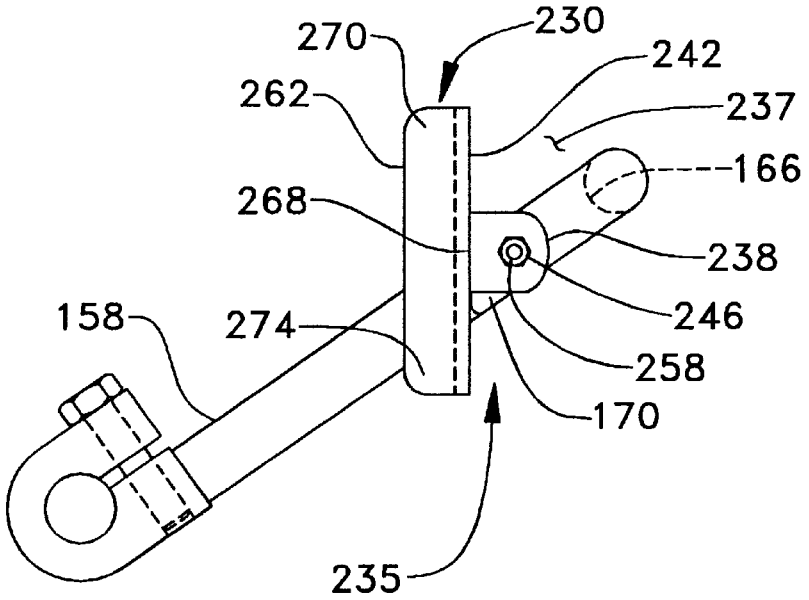
FIGS. 4 and 5 are diagrammatic partial side views of a first and a second position of a pedal assembly of the present invention.
Figure 5:
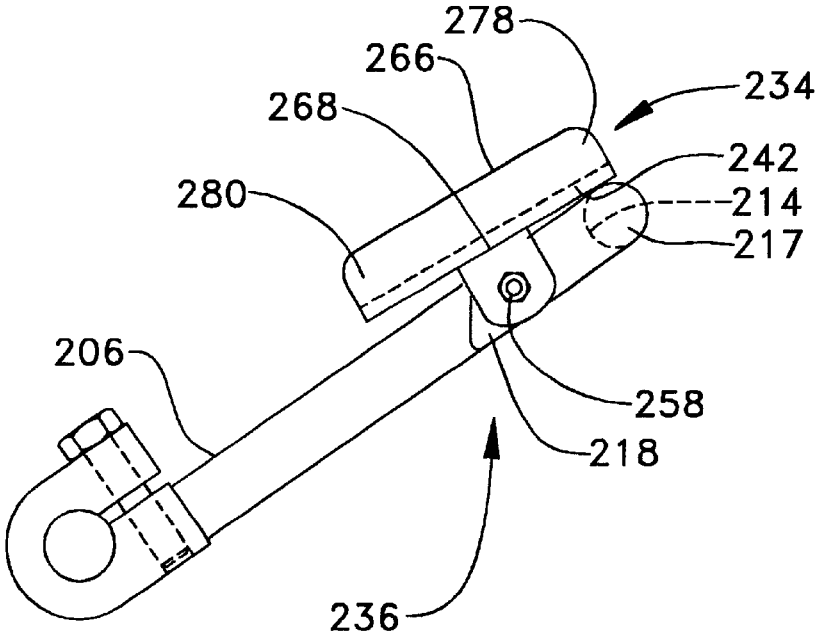

A foot pedal assembly 108, which is connected to the actuating device 54, is located within the cab portion 18 and is more clearly illustrated in FIGS. 2 and 4–5. A linkage assembly 110 is partially disposed within the housing 82 and is operatively associated with the actuating device 54 in a well known manner. The linkage assembly 110 includes a pair of shafts 114,115 which extend through the bore 98. It should be understood that a single shaft of suitable design may be used. A first end portion 118 of the shafts 114,115 extend beyond the outer surface 94 of the housing 82 at the first and second side portions 102,106, respectively. The shafts 114,115 are operatively associated and connected through the linkage assembly 110 at a second end portion 122. A first rod assembly 126 and a second rod assembly 130 are connected to the first end portion 118 of the shafts 114,115, respectively, at a predetermined angle.

The first rod assembly 126 has a block 134 with a circumferential bore 138 therethrough surrounding the first end portion 118. The block 134 has a split flange portion 142 which extends from the bore 138 to define an open end 146 which separates the block 134 into an upper and lower flange 150,154. A bolt and washer assembly 155 extends through a threaded bore 156 in the block 134 within the upper and lower flanges 150,154. A j-shaped rod 158 is connected to the block 134 at a connecting joint 162 in any suitable manner, such as welding. The rod 158 has a first leg 164 and an intermediate portion 166 which is angled approximately 90° from the first leg 164 by a curved portion 167. It should be understood that the intermediate portion 166 could be angled from the first leg 164 in any suitable manner, such as through a straight 90° bend or any series of angled designs. The first leg 164 extends from the block 134 a predetermined distance and terminates at a second leg 168 which is angled approximately 90° from the intermediate portion 166 by a curved portion 169. It should be understood that the second leg 168 could be angled from the intermediate portion 166 in any suitable manner, such as through a straight 90° bend or any series of angled designs. It should also be understood that any other suitable configuration of the rod 158, such as a t-shape, z-shape, etc., which would provide similar results may be used. The second leg 168 has a distal end portion 170 and a bore 178 defined therethrough.

The second rod assembly 130 has a block 182 with a circumferential bore 186 therethrough surrounding the second end portion 122. The block 182 has a split flange portion 190 which extends from the bore 186 to define an open end 194 which separates the block 182 into an upper and lower flange 198,202, respectively. A bolt and washer assembly 203 extends through a threaded bore 204 in the block 182 within the upper and lower flanges 198,202. A j-shaped rod 206 is connected to the block 182 at a connecting joint 210 in any suitable manner, such as welding. The rod 206 has a first leg 212 and an intermediate portion 214 which is angled approximately 90° from the first leg 212 by a curved portion 215. It should be understood that the intermediate portion 214 could be angled from the first leg 212 in any suitable manner, such as through a straight 90° bend or any series of angled designs. The first leg 212 extends from the block 182 a predetermined distance and terminates at a second leg 216 which is angled approximately 90° from the intermediate portion 214 by a curved portion 217. It should be understood that the second leg 216 could be angled from the intermediate portion 214 in any suitable manner, such as through a straight 90° bend or any series of angled designs. It should also be understood that any other suitable configuration of the rod 206, such as a t-shape, z-shape, etc., which would provide similar results may be used. The second leg 216 has a distal end portion 218 and a bore 226 defined therethrough.

As can be seen more clearly in FIGS. 4 and 5 in conjunction with FIG. 2, a first pedal assembly 230 and a second pedal assembly 234 are pivotally connected respectively at a first position 235 and a second position 236 to the rods 158,206, respectively, through a pair of spaced mounting ears, one of which is shown at 238 attached at a mounting surface 242 thereof. A space 237 having a predetermined height is defined between the first and second pedal assemblies 230,234 and the rods 158,206, respectively, when the first and second pedal assemblies 230,234 are in the second position 236. A bore, one of which is shown at 246, is defined through the spaced ears 238 in substantial axial alignment with the bores 178,226 in the distal end portions 170,218. A nut and bolt assembly 254 is threaded through each of the bores 178,226 in the distal end portions 170,218 and the bores 246 in the spaced ears 238 in any suitable manner to define a pivot 258. The first and the second pedal assemblies 230,234 each have a foot plate 262,266 welded to the spaced ears 238 at a central location 268 thereof. The foot plates 262,266 each have an upper and lower portion 270,274,278,280, respectively, with the lower portions 274, 280 defined at a greater distance from the bucket assembly 34 than the upper portions 270,278. The foot plates 262,266 each have an upwardly extending lip portion 282 at an outer side portion 283. A non-skid surface 284 opposite the mounting surface 242 extends from the lip portion 282 and includes a plurality of upwardly extending protrusions 285.

Referring again to FIG. 2, adjustment plate 286,290 is positioned inwardly of the distal end portions against the intermediate portions 166,214 of the rods 158,206 at a bifurcated end portion 294,298. The bifurcated end portions 294,298 have a recessed notch 302,306 which partially surrounds the intermediate portions 166,214. The adjustment plates 286,290 each have a slotted end portion, one of which is shown at 310, opposite the bifurcated end portions 294,298. The nut and bolt assembly 254 extends through an elongated opening, one of which is shown at 318, on the slotted end portions 310 and into the bores 246 of the spaced ears 238 and the bores 178,226 in the distal end portions 170,218 to connect the adjustment plates 286,290 to the first and second pedal assemblies 230,234, respectively.

Figure 3:
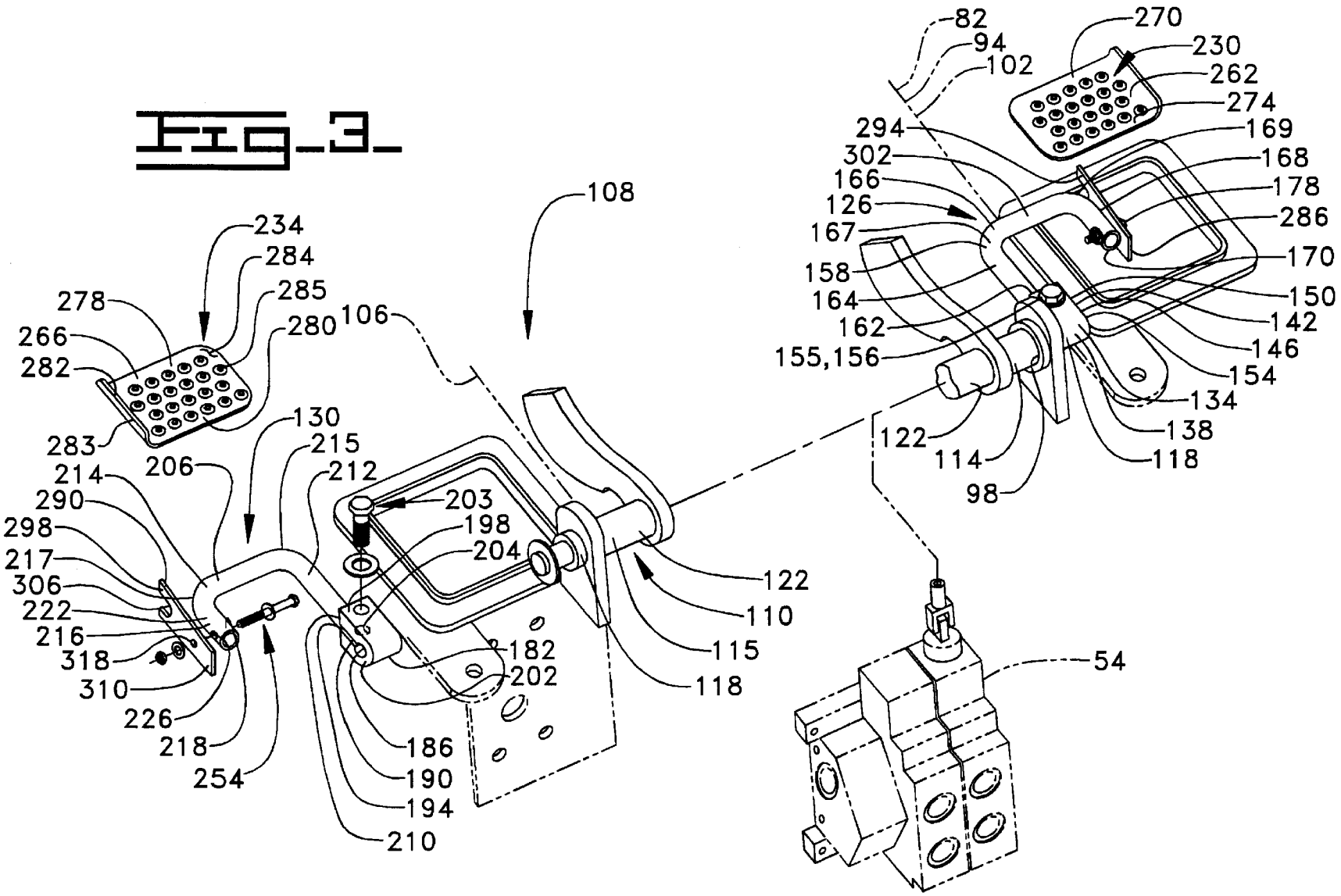
FIG. 3 is an diagrammatic exploded view of an another embodiment of the present invention.

Another embodiment of the present invention is shown in FIG. 3. It should be noted that the same reference numerals of the first embodiment are used to designate similarly constructed counterpart elements of this embodiment. As can be seen more clearly in FIG. 3, the adjustment plates 286,290 are positioned outwardly of the distal end portions 170,218, respectively. The nut and bolt assembly 254 extends through the bores 246 of the spaced ears 238 and the bores 178,226 in the distal end portions 170,218 and into the elongated openings 318 on the slotted end portions 310 to connect the adjustment plates 286,290 to the first and second pedal assemblies 230,234, respectively.

Industrial Applicability

In order to move the boom arm 38, pressure is applied to the first and second pedal assemblies 230,234 by an operator (not shown). It should be understood that the pressure applied by the operator (not shown) could be applied in any other suitable manner, such as through an external pressure source. Pressure may be applied to the first and second pedal assemblies 230,234 at any angular position between the first and second positions 235,236 due to the pivotal connection of the first and second pedal assemblies 230,234 with the j-shaped rods 158,206, respectively.

In the first position 235, the lower portions 274,280 of the foot plates 262,266, respectively, contact the distal end portions 170,218 of the j-shaped rods 159,206. In the second position 236, the upper portions 270,278 of the foot plates 262,266, respectively, contact the intermediate portions 166, 214 of the j-shaped rods 158,206. The contact of the foot plates 262,266 with the distal end portions 170,218 and the intermediate portions 166,214 allows for controlled pivotal movement of the first and second pedal assemblies 230,234 between the first and second positions 235,236.

The blocks 134,182 may be positioned on the respective end of the shafts 114,115 in any angular position selected by the operator (not shown). Once positioned, a pressure is applied to the split flange portions 142,190 by connecting the bolt and washer assemblies 155,203 through the upper and lower flanges 150,198,154,202 and tightening the assemblies 155,203 in a well known manner. The adjustment plates 286,290 are positioned precisely on the intermediate portions 166,214 and have a sufficient length for contacting the foot plates 262,266 so that the selected angular position of the blocks 134,182 may be maintained throughout operation. The adjustment plates 286,290 are optional and may be connected to the first and second pedal assemblies 230,234 outside the j-shaped rods 158,206, respectively, so that the operator (not shown) has the ability to apply pressure to the first and second pedal assemblies 230,234 at any angle between the first and second position 235,236 without fixing the angular position by the adjustment plates 286,290.

In view of the above, the ability to pivot a pedal assembly between a first position and a second position and angularly position the pedal assembly increases an operator's ability for control and comfort.

We claim:

1. A foot pedal assembly, comprising:

a linkage assembly operatively associated with and adapted for connection with an actuating device, the linkage assembly having a shaft extending therethrough with a first end and a second end;

a first rod assembly connected to the first end of the shaft and having a first shaped rod extending a predetermined distance from the shaft, the first rod having a distal end portion;

a second rod assembly connected to the second end of the shaft and having a second shaped rod extending a predetermined distance from the shaft, the second rod having a distal end portion; and a first pedal assembly pivotally connected between a first and a second position at a first predetermined pivot location proximate the distal end portion of the first rod and a second pedal assembly pivotally connected between a first and a second position at a second predetermined pivot location proximate the distal end portion of the second rod, the first and second pedal assemblies being operatively associated to control the actuating device.

2. The foot pedal assembly of claim 1, wherein the first and the second pedal assemblies each have a foot plate with an upper and lower portion and a pair of spaced ears located at a central portion of each of the foot plates, the pair of spaced ears of the first and the second foot pedal assemblies being connected at the respective first and second pivot locations to the first and the second rods with the lower portions of each of the foot plates contacting the distal end portions of the first and the second rods at the first position.

3. The foot pedal assembly of claim 2, wherein the first and second rods each have an intermediate portion with the upper portions of each of the foot plates contacting the intermediate portions of the first and the second rods at the second position.

4. The foot pedal assembly of claim 3, including an adjustment plate with a first end connected to each of the foot plates and with a second end partially surrounding the intermediate portions of each of the first and second rods.

5. The foot pedal assembly of claim 4, wherein the first and the second rod assemblies each have a block connected to the shaft at an end opposite the distal end portion.

6. The foot pedal assembly of claim 5, wherein the blocks are connected to the shaft at a preselected angular position and the adjustment plates have a predetermined length for holding each of the foot plates at the preselected angular position.

7. The foot pedal assembly of claim 6, wherein the blocks of the first and the second rod assemblies each have a bore circumferentially surrounding the first and second ends of the shaft and a split flange portion extending from the bore, the split flange portion being adapted to apply pressure to the first and the second ends of the shaft during connection thereto.

8. The foot pedal assembly of claim 2, wherein each of the foot plates have a non-skid surface with a plurality of protrusions and a upwardly extending lip at an outer side portion.

* * * * *